US011393374B2

(12) United States Patent
Seo et al.

(10) Patent No.: US 11,393,374 B2
(45) Date of Patent: Jul. 19, 2022

(54) DISPLAY DEVICE AND METHOD OF DRIVING THE SAME

(71) Applicant: Samsung Display Co., Ltd., Yongin-Si (KR)

(72) Inventors: Won Jin Seo, Yongin-si (KR); Eun Jin Choi, Yongin-si (KR); Ki Hyun Pyun, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/006,997

(22) Filed: Aug. 31, 2020

(65) Prior Publication Data

US 2021/0264832 A1 Aug. 26, 2021

(30) Foreign Application Priority Data

Feb. 20, 2020 (KR) ..... 10-2020-0021274

(51) Int. Cl.
*G09G 3/20* (2006.01)

(52) U.S. Cl.
CPC ..... *G09G 3/20* (2013.01); *G09G 2310/027* (2013.01)

(58) Field of Classification Search
CPC .. G09G 3/20; G09G 2310/027; G09G 3/2007; G09G 2320/0242; G09G 2320/0285; G09G 2320/045; G09G 3/3233; G09G 2320/0209; G09G 2330/021
See application file for complete search history.

(56) References Cited

U.S. PATENT DOCUMENTS

| | | | | |
|---|---|---|---|---|
| 8,749,467 | B2 * | 6/2014 | Lee | G09G 3/3614 345/99 |
| 9,087,481 | B2 * | 7/2015 | Park | G09G 3/3208 |
| 9,159,284 | B2 | 10/2015 | Park et al. | |
| 9,251,761 | B2 * | 2/2016 | Shigeta | G09G 3/2003 |
| 9,552,783 | B2 | 1/2017 | Kim | |
| 10,339,881 | B1 * | 7/2019 | Tung | G09G 3/3607 |
| 10,706,771 | B2 * | 7/2020 | Hwang | G09G 3/3266 |
| 10,726,783 | B2 * | 7/2020 | Park | G09G 3/3233 |
| 11,238,775 | B1 * | 2/2022 | Li | G09G 3/3208 |

(Continued)

FOREIGN PATENT DOCUMENTS

| | | | |
|---|---|---|---|
| KR | 10-1390056 | B1 | 5/2014 |
| KR | 10-2015-0101512 | A | 9/2015 |

(Continued)

*Primary Examiner* — Grant Sitta
(74) *Attorney, Agent, or Firm* — Innovation Counsel LLP

(57) ABSTRACT

A display device and a method of driving the same are provided. The display device according to an embodiment includes a plurality of pixel rows, a data driver configured to provide first data voltages which correspond to first line grayscale data to pixels disposed in an (N−1)-th pixel row, provide second data voltages which correspond to second line grayscale data to pixels disposed in an N-th pixel row, and provide third data voltages which correspond to third line grayscale data to pixels disposed in an (N+1)-th pixel row, and a data compensator configured to compensate for the second line grayscale data by using one of a first compensation and a second compensation based on the first line grayscale data, the second line grayscale data, and the third line grayscale data.

20 Claims, 9 Drawing Sheets

(56) References Cited

U.S. PATENT DOCUMENTS

| | | | | |
|---|---|---|---|---|
| 2007/0057975 | A1* | 3/2007 | Oh | G09G 3/3648 345/690 |
| 2009/0219306 | A1* | 9/2009 | Oh | G09G 3/3225 345/690 |
| 2009/0225105 | A1* | 9/2009 | Park | G09G 3/3688 345/690 |
| 2011/0109661 | A1* | 5/2011 | Lee | G09G 3/20 345/690 |
| 2011/0254759 | A1* | 10/2011 | Mori | G09G 3/3607 345/88 |
| 2015/0049123 | A1* | 2/2015 | Choi | G09G 3/2003 345/690 |
| 2016/0093270 | A1* | 3/2016 | Lee | G09G 3/3688 345/82 |
| 2016/0140927 | A1* | 5/2016 | Maruyama | G09G 3/3688 345/89 |
| 2016/0372022 | A1* | 12/2016 | Maruyama | G09G 3/3685 |
| 2017/0069250 | A1* | 3/2017 | Wang | G09G 3/2003 |
| 2018/0075795 | A1* | 3/2018 | Lin | G09G 3/36 |
| 2018/0137830 | A1* | 5/2018 | Lee | G09G 3/3607 |
| 2018/0277049 | A1* | 9/2018 | Pan | G09G 3/2074 |
| 2019/0385548 | A1* | 12/2019 | Chen | G09G 3/3688 |

FOREIGN PATENT DOCUMENTS

| | | | |
|---|---|---|---|
| KR | 10-1958738 | B1 | 3/2019 |
| KR | 10-2019346 | B1 | 11/2019 |

* cited by examiner

FIG. 5

| DS OUTPUT | | |
|---|---|---|
| | DX1>A | DX1≤A |
| DX2>A | 0 | 1 |
| DX2≤A | 1 | 0 |

FIG. 9

| DS OUTPUT | | | |
|---|---|---|---|
| | DX1>A | 0<DX1≤A | DX1=0 |
| DX2>A | 0 | 1 | 1 |
| 0<DX2≤A | 1 | 0 | 0 |
| DX2=0 | 1 | 0 | NC |

DISPLAY DEVICE AND METHOD OF DRIVING THE SAME

This application claims priority to Korean Patent Application No. 10-2020-0021274, filed on, Feb. 20, 2020, and all the benefits accruing therefrom under 35 U.S.C. § 119, the content of which in its entirety is herein incorporated by reference.

BACKGROUND

1. Field

The disclosure relates to a display device and a method of driving the same.

2. Description of the Related Art

As an information technology is developed, importance of a display device, which is a connection medium between a user and information, is emphasized. Accordingly, use of a display device such as a liquid crystal display device, an organic light emitting display device, and a plasma display device has been increasing.

The display device displays an image frame by using a plurality of pixels which emit light. When displaying the image frame, a line crosstalk defect may occur that degrades display quality depending on a pattern of the image frame. When the line crosstalk defect occurs, an unintended bright line or dark line is displayed, and thus a user may recognize the unintended bright line or dark line as a display error.

SUMMARY

An object of the disclosure is to provide a display device and a method of driving the same capable of minimizing a line crosstalk defect by preventing a data voltage from being excessively applied.

In addition, another object of the disclosure is to provide a display device and a method of driving the same capable of reducing power consumption by preventing a data voltage from being unnecessarily compensated.

The objects of the disclosure are not limited to the above-described objects, and other technical objects that are not described above will be clearly understood by those skilled in the art from the following description.

A display device according to an embodiment of the disclosure for resolving the above-described object includes a plurality of pixel rows each including a plurality of pixels, a data driver configured to provide first data voltages which correspond to first line grayscale data to pixels disposed in an (N−1)-th pixel row (N is a natural number greater than 2), provide second data voltages which correspond to second line grayscale data to pixels disposed in an N-th pixel row, and provide third data voltages which correspond to third line grayscale data to pixels disposed in an (N+1)-th pixel row, and a data compensator configured to compensate for the second line grayscale data by using one of a first compensation and a second compensation based on the first line grayscale data, the second line grayscale data, and the third line grayscale data. The data driver provides a compensated second data voltage to the N-th pixel row based on compensation grayscale data in which the second line grayscale data is compensated, the second line grayscale data is compensated such that a data voltage greater than a data voltage corresponding to the second line grayscale data is output, by the first compensation, and the second line grayscale data is compensated such that a data voltage less than the data voltage corresponding to the second line grayscale data is output, by the second compensation.

The data compensator may include a first driver configured to output one of a first activation signal and a second activation signal for selecting the one of the first compensation and the second compensation based on the first line grayscale data, the second line grayscale data, and the third line grayscale data, and a second driver configured to output the compensation grayscale data in response to the one of the first activation signal and the second activation signal.

The first driver may include a first data comparator configured to compare the first line grayscale data with the second line grayscale data to output a first line comparison value, a second data comparator configured to compare the second line grayscale data with the third line grayscale data to output a second line comparison value, and a compensation determiner configured to output the one of the first activation signal and the second activation signal based on the first line comparison value and the second line comparison value.

The compensation determiner may include a first determiner configured to output determination data based on the first line comparison value and the second line comparison value, and a second determiner configured to output the one of the first activation signal and the second activation signal based on the determination data.

The first determiner may compare each of the first line comparison value and the second line comparison value with a preset first reference value, when both of the first line comparison value and the second line comparison value are greater or less than the first reference value, the first determiner may output a first value as the determination data, and when only one of the first line comparison value and the second line comparison value is greater than the first reference value, the first determiner may output a second value as the determination data.

The second determiner may compare a sum of the determination data with a preset second reference value, when the sum of the determination data is less than the second reference value, the second determiner may output the first activation signal, and when the sum of the determination data is greater than the second reference value, the second determiner may output the second activation signal.

When all of the first line grayscale data, the second line grayscale data, and the third line grayscale data are the same, the first driver may output a third activation signal, and the second driver may output the second line grayscale scale data as it is in response to the third activation signal.

The second driver may include a first compensator configured to output first compensation data using the first compensation in response to the first activation signal, and a second compensator configured to output second compensation data using the second compensation in response to the second activation signal. The second driver may output one of the first compensation data and the second compensation data as the compensation grayscale data.

The second data voltage corresponding to the first compensation data may be greater than the data voltage corresponding to the second line grayscale data.

The first compensator may include a first lookup table in which the first compensation data corresponding to a relationship between the first line grayscale data and the second line grayscale data is stored.

The second data voltage corresponding to the second compensation data may be less than the data voltage corresponding to the second line grayscale data.

The second compensator may include a second lookup table in which the second compensation data corresponding to a relationship between the first line data and the second line data is stored.

A method of driving a display device according to an embodiment of the disclosure for resolving the above-described object is a method of driving a display device including a plurality of pixel rows, a data driver configured to provide data voltages to the plurality of pixel rows, and a data compensator configured to output compensation grayscale data. The method includes comparing first line grayscale data for an (N−1)-th pixel row (N is a natural number greater than 2) with second line grayscale data for an N-th pixel row to output a first line comparison value, comparing the second line grayscale data with a third line grayscale data for an (N+1)-th pixel row to output a second line comparison value, outputting one of a first activation signal activating a first compensation and a second activation signal activating a second compensation based on the first line comparison value and the second line comparison value, outputting the compensation grayscale scale data in response to correspondence with the one of the first activation signal and the second activation signal, and providing data voltages to the N-th pixel row based on the compensation grayscale data. The second line grayscale data is compensated such that a data voltage greater than a data voltage corresponding to the second line grayscale data is output, by the first compensation, and the second line grayscale data is compensated such that a data voltage less than the data voltage corresponding to the second line grayscale data is output by the second compensation.

Outputting the one of the first activation signal and the second activation signal may include outputting determination data based on the first line comparison value and the second line comparison value, and determining the one of the first activation signal and the second activation signal based on a sum of the determination data.

Outputting the determination data may include comparing the first line comparison value and the second line comparison value with a preset first reference value, outputting a first value as the determination data when both of the first line comparison value and the second line comparison value are greater or less than the first reference value, and outputting a second value as the determination data when only one of the first line comparison value and the second line comparison value is greater than the first reference value.

The first activation signal may be output when the sum of the determination data is less than a second reference value by comparing the sum of the determination data with the second reference value.

The second activation signal may be output when the sum of the determination data is greater than a second reference value by comparing the sum value of the determination data with the second reference value.

Outputting the compensation grayscale data may include outputting first compensation data in response to the first activation signal, outputting second compensation data in response to the second activation signal, and outputting one of the first compensation data and the second compensation data as the compensation grayscale data.

Outputting the first compensation data in response to the first activation signal may include using a first lookup table in which the first compensation data corresponding to a relationship between the first line grayscale data and the second line grayscale data is stored, and a data voltage corresponding to the first compensation data may be greater than the data voltage corresponding to the second line grayscale scale data.

Outputting the second compensation data in response to the second activation signal may include using a second lookup table in which the second compensation data corresponding to a relationship between the first line grayscale data and the second line grayscale data is stored, and a data voltage corresponding to the second compensation data may be less than the data voltage corresponding to the second line grayscale scale data.

Specific details of other embodiments are included in the detailed description and drawings.

The display device and the method of driving the display device according to embodiments of the disclosure may minimize a line crosstalk defect of the display device by preventing a data voltage from being excessively applied.

In addition, the display device and the method of driving the display device according to embodiments of the disclosure may reduce power consumption of the display device by preventing a data voltage from being unnecessarily compensated.

The effect according to the embodiments is not limited by the details illustrated above, more various effects are included in the present specification.

BRIEF DESCRIPTION OF THE DRAWINGS

The above and other features of the disclosure will become more apparent by describing in further detail embodiments thereof with reference to the accompanying drawings, in which:

FIG. 5 is a diagram for describing determination data output by a first determiner included in the first driver of FIG. 4;

FIG. 9 is a diagram for describing determination data output by a first determiner included in the first driver of FIG. 8.

DETAILED DESCRIPTION OF THE EMBODIMENT

Figure 1:
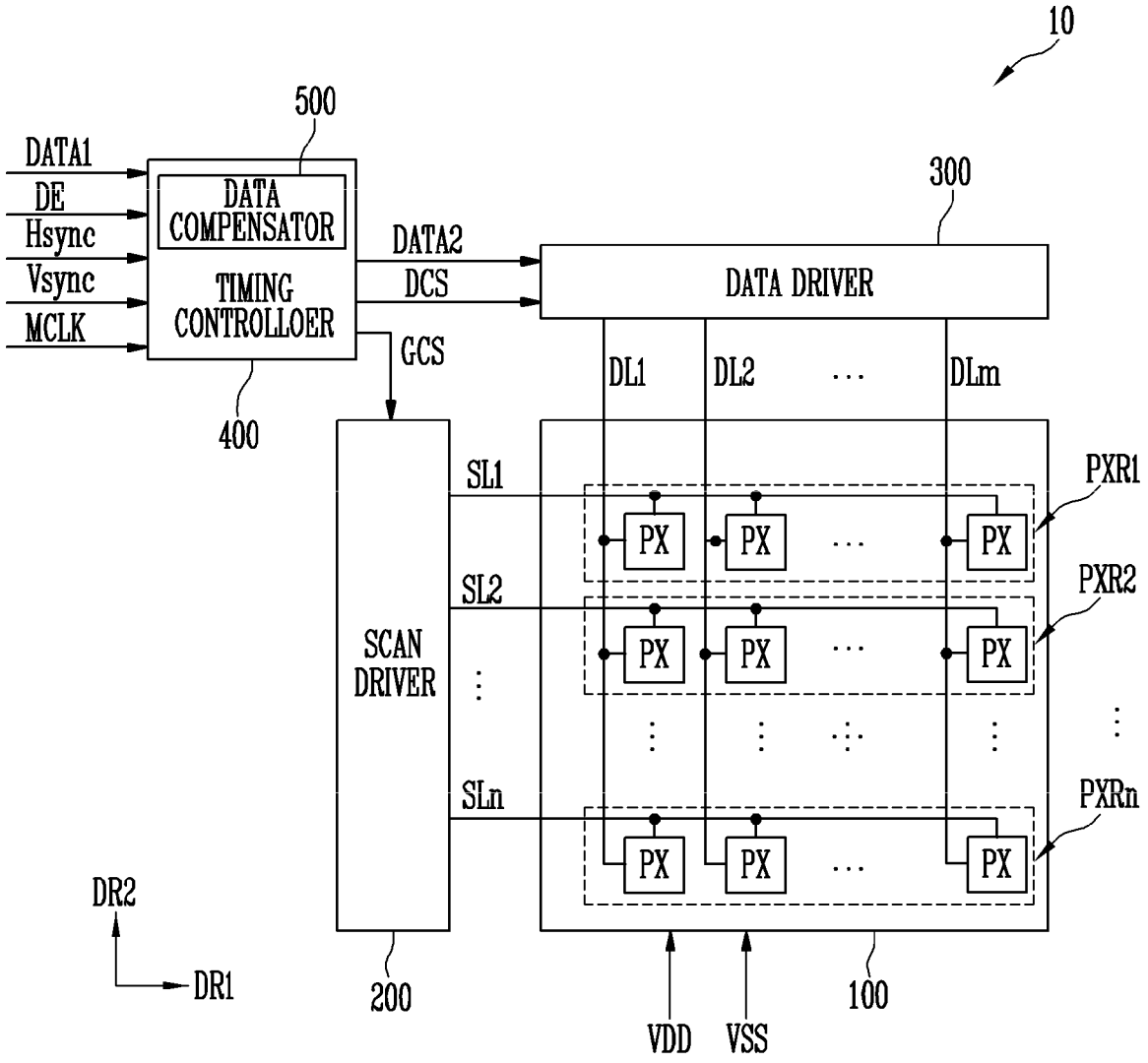
FIG. 1 is a diagram schematically illustrating a display device according to an embodiment of the disclosure.

The advantages and features of the disclosure and a method of achieving them will become apparent with reference to the embodiments described in detail below together with the accompanying drawings. However, the disclosure is not limited to the embodiments disclosed below, and may be implemented in various different forms. The present embodiments are provided so that the disclosure will be thorough and complete and those skilled in the art to which the disclosure pertains can fully understand the scope of the disclosure. The disclosure is only defined by the scope of the claims.

A case in which an element or a layer is referred to as "on" another element or layer includes a case in which another layer or another element is disposed directly on the other element or between the other layers. The same reference numerals denote to the same components throughout the specification. A shape, a size, a ratio, an angle, the number, and the like disclosed in the drawings for describing the embodiments are exemplary, and thus, the disclosure is not limited thereto.

Although a first, a second, and the like are used to describe various components, these components are not limited by these terms. These terms are used only to distinguish one component from another component. Therefore, a first component mentioned below may be a second component within the technical spirit of the disclosure. Singular expressions include plural expressions unless the context clearly indicates otherwise. The same or similar reference numerals are used for the same components in the drawings.

Each of features of various embodiments of the disclosure may be coupled or combined with each other in part or in whole, and technically various interlocking and driving are possible. Each embodiment may be implemented independently of each other and association thereof may be implemented together.

Hereinafter, embodiments of the disclosure will be described in detail with reference to the accompanying drawings.

FIG. 1 is a diagram schematically illustrating a display device according to an embodiment of the disclosure.

Referring to FIG. 1, the display device 10 according to an embodiment may include a display area 100, a scan driver 200, a data driver 300, a timing controller 400, and a data compensator 500.

The display area 100 may display an image. The display area 100 may be implemented as a display panel. The display area 100 may include various display elements such as an organic light emitting element (for example, an organic light emitting diode (OLED)). Hereinafter, for convenience, the display device 10 including the organic light emitting element as the display element will be described. However, the disclosure is not limited thereto and may be applied to various methods of display devices such as a liquid crystal display device (LCD), an electrophoretic display device (EPD), and an inorganic light emitting display device.

The display area 100 may include data lines DL1 to DLm (where m is a positive integer), scan lines SL1 to SLn (where n is a positive integer) (or gate lines, and pixels PX. Each pixel PX may be disposed in an area partitioned by the data lines DL1 to DLm and the scan lines SL1 to SLn. The pixels PX may be electrically connected to the data lines DL1 to DLm and the scan lines SL1 to SLn.

For example, the pixel PX disposed in a first row and a first column may be connected to the first data line DL1 and the first scan line SL1. For another example, the pixel PX disposed in an n-th row and an m-th column may be connected to the m-th data line DLm and the n-th scan line SLn.

However, the pixel PX is not limited thereto. For example, the pixel PX may be connected to scan lines corresponding to adjacent rows (for example, a scan line corresponding to a previous row and a scan line corresponding to a subsequent row of the row including the pixel PX).

Figure 2:
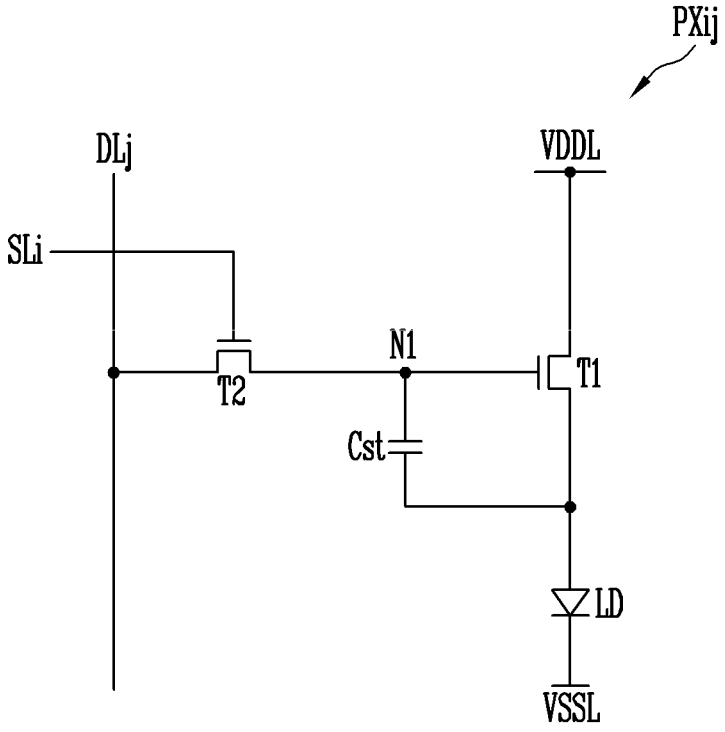
FIG. 2 is a circuit diagram illustrating an example of a pixel included in the display device of FIG. 1.

In addition, the pixel PX may be electrically connected to a first driving voltage line and a second driving voltage line to receive a first driving voltage VDD and a second driving voltage VSS as disclosed in FIG. 2. Here, the first driving voltage VDD and the second driving voltage VSS may be voltages required for driving the pixel PX. Here, the first driving voltage VDD may have a value greater than that of the second driving voltage VSS. Meanwhile, an initialization voltage or the like may be further supplied to the pixel PX.

The pixel PX may emit light at a luminance corresponding to a data signal provided through a corresponding data line in response to a scan signal provided through a corresponding scan line. Detailed configuration and operation of the pixel PX will be described later with reference to FIG. 2.

Meanwhile, the plurality of pixels PX may include a plurality of pixel rows PXR1 to PXRn. For example, a first pixel row PXR1 may include a plurality of pixels PX connected to a first scan line SL1, and a second pixel row PXR2 may include a plurality of pixels PX connected to a second scan line SL2. Similarly, an n-th pixel row PXRn may include a plurality of pixels PX connected to an n-th scan line SLn.

The scan driver 200 (or a gate driver) may generate a scan signal (or a gate signal) based on a gate control signal GCS, and provide the scan signal to the scan lines SL1 to SLn. Here, the gate control signal GCS may be a signal for controlling an operation of the scan driver 200 and may include a start signal, clock signals, and the like. For example, the scan driver 200 may sequentially generate and output a scan signal (for example, a scan signal having a waveform the same as or similar to a waveform of the start signal) corresponding to the start signal using the clock signals. The scan driver 200 may be implemented as a shift register, but is not limited thereto. The scan driver 200 may be formed on one area of the display area 100, or may be implemented as an integrated circuit and may be mounted on a flexible circuit board to be connected to the display area 100.

The data driver 300 may be implemented as an integrated circuit (IC) (for example, a driver IC), or may be mounted on a flexible circuit board to be connected to the display area 100. The data driver 300 may generate data signals (or data voltages) based on image data DATA2 and a data control signal DCS, and may provide the data signals to each of the pixel rows PXR1 to PXRn through the data lines DL1 to DLm. Here, the data control signal DCS is a signal for controlling an operation of the data driver 300 and may include a load signal, a start signal, clock signals, and the like.

The image data DATA2 provided to the data driver 300 may include grayscale information (or line grayscale data) corresponding to each of the pixel rows PXR1 to PXRn. The data driver 300 may provide the data voltages to the pixel rows PXR1 to PXRn corresponding to the line grayscale data. Here, the image data DATA2 provided to the data driver 300 may be data including line grayscale data compensated by the data compensator 500 which will be described later. The line grayscale data will be described later with reference to FIG. 3.

The timing controller 400 may receive input image data DATA1 (for example, RGB data) for each frame and input control signals from an external processor (for example, a graphic processor). The input image data DATA1 may include grayscale values corresponding to each of the pixels PX. The input control signals may include a vertical synchronization signal Vsync, a horizontal synchronization signal Hsync, a main clock signal MCLK, a data enable signal DE, and the like.

The timing controller 400 may generate the image data DATA2 based on the input image data DATA1. Specifically, the timing controller 400 may render the input image data DATA1 so that the input image data DATA1 corresponds to a specification of the display device 10. For example, the external processor may provide a red grayscale value, a green grayscale value, and a blue grayscale value for each unit dot. For example, when the display area 100 is an RGB stripe structure, pixels may correspond to respective grayscales value one-to-one. In this case, rendering of the input image data DATA1 may not be required. However, for example, when the display area 100 has a pentile structure, since adjacent unit dots share the pixels, the pixels may not correspond to respective grayscale values one-to-one. In this case, rendering of the input image data DATA1 may be required. The image data that is rendered or not rendered by the timing controller 400 may be provided to the data driver 300 (or the data compensator 500).

In addition, the timing controller 400 may generate the gate control signal GCS and the data control signal DCS based on the input control signals. The timing controller 400 may provide the gate control signal GCS to the scan driver 200, and may provide the data control signal DCS to the data driver 300.

The data compensator 500 may compensate for the image data DATA2 generated by the timing controller 400. As described above, the image data DATA2 may include the grayscale information (or line grayscale data) corresponding to the each of the pixel rows PXR1 to PXRn. The data compensator 500 may compensate for line grayscale data of a current pixel row (a p-th pixel row, p may be a natural number greater than 1) using line grayscale data of a previous pixel row (for example, a (p−1)-th pixel row), the line grayscale data of the current pixel row (for example, a p-th pixel row), and line grayscale data of a subsequent pixel row (for example, a (p+1)-th pixel row).

The data compensator 500 may make compensation for the input image data DATA1 to generate the image data DATA2 which is compensated using one of a first compensations and a second compensation. The image data DATA2 which is compensated by the first compensation may be data compensated to improve a charge rate of the pixels included in the current pixel row. As an embodiment, the first compensation may be a compensation for increasing a magnitude of the data voltage output to the current pixel row by the data driver 300. As another embodiment, the first compensation may be a compensation for reducing the magnitude of the data voltage output to the current pixel row by the data driver 300.

The image data DATA2 which is compensated by the second compensation may be data compensated for improving a crosstalk defect of the pixels included in the current pixel row. For example, the second compensation may be a compensation for reducing the magnitude of the data voltage output to the current pixel row by the data driver 300.

Detailed configuration and operation of the data compensator 500 will be described later with reference to FIG. 3.

Meanwhile, in FIG. 1, the timing controller 400 and the data driver 300 are implemented as separate components, but is not limited thereto. For example, the timing controller 400 may be implemented as one integrated circuit (for example, a timing controller embedded driver (TED)) together with the data driver 300.

In addition, as shown in FIG. 1, the data compensator 500 may be a component included in the timing controller 400. For example, the data compensator 500 may be implemented as one integrated circuit together with the timing controller 400, or may be included in the timing controller 400 so that some or all of the data compensator 500 is implemented as software. However, the data compensator 500 is not limited thereto. For example, the data compensator 500 and the timing controller 400 may be implemented as separate components or may be implemented in one component.

FIG. 2 is a circuit diagram illustrating an example of the pixel included in the display device of FIG. 1.

Referring to FIG. 2, the pixel PXij may be connected to a scan line SLi and a data line DLj. Here, the scan line SLi may be one of the scan lines SL1 to SLn of FIG. 1, and the data line DLj may be one of the data lines DL1 to DLm of FIG. 1.

The pixel PXij may include a light emitting element LD, a first transistor T1, a second transistor T2, and a storage capacitor Cst.

In the present embodiment, although the transistors are shown as N-type transistors, for example NMOSs, those skilled in the art will be able to configure a pixel circuit having the same function with P-type transistors, for example PMOSs.

A first electrode (for example, an anode electrode) of the light emitting element LD may be connected to a first driving voltage line VDDL through the first transistor T1, and a second electrode (for example, a cathode electrode) of the light emitting element LD may be connected to a second driving voltage line VSSL. The first driving voltage line VDDL may be a line providing the first driving voltage VDD of FIG. 1, and the second driving voltage line VSSL may be a line providing the second driving voltage VSS of FIG. 1.

A first electrode of the first transistor T1 (driving transistor) may be connected to the first driving voltage line VDDL, and a second electrode of the first transistor T1 may be connected to the first electrode of the light emitting element LD. A gate electrode of the first transistor T1 may be connected to a first node N1. The first transistor T1 may control an amount of a driving current supplied to the light emitting element LD in response to a voltage of the first node N1.

A first electrode of the second transistor T2 (switching transistor) may be connected to the data line DLj, and a second electrode of the second transistor T2 may be connected to the first node N1. A gate electrode of the second transistor T2 may be connected to the scan line SLi.

One electrode of the storage capacitor Cst may be connected to the first node N1, and another electrode may be connected to an anode electrode of the light emitting diode LD. The storage capacitor Cst may be charged with a voltage corresponding to a data signal of one frame, and may maintain the charged voltage until the data signal of a next frame is supplied.

When a scan signal of a turn-on level is supplied to the gate electrode of the second transistor T2 through the scan line SLi, the second transistor T2 may connect the data line DLj and the one electrode of the storage capacitor Cst. Therefore, a voltage difference between the data voltage applied through the data line DLj and a voltage of the anode electrode of the light emitting diode LD may be written to the storage capacitor Cst.

The first transistor T1 may allow a driving current determined according to the voltage written to the storage capacitor Cst to flow from the first driving voltage line VDDL to the second driving voltage line VSSL. The light emitting element LD may emit light according to a driving current flowing through the light emitting element LD.

For convenience of description, FIG. 2 shows a pixel circuit of a relatively simple structure including the second transistor T2 for transferring the data signal into the pixel PXij, the storage capacitor Cst for storing the data signal, and the first transistor T1 for supplying the driving current corresponding to the data signal to the light emitting element LD.

However, the disclosure is not limited thereto, and the structure of the pixel circuit may be variously changed and implemented. For example, the pixel circuit may further include various transistors such as a compensation transistor for compensating for a threshold voltage of the first transistor T1, an initialization transistor for initializing the first node N1 or the anode electrode of the light emitting element LD, and/or a light emission control transistor for controlling a light emission time of the light emitting element LD.

Figure 3:
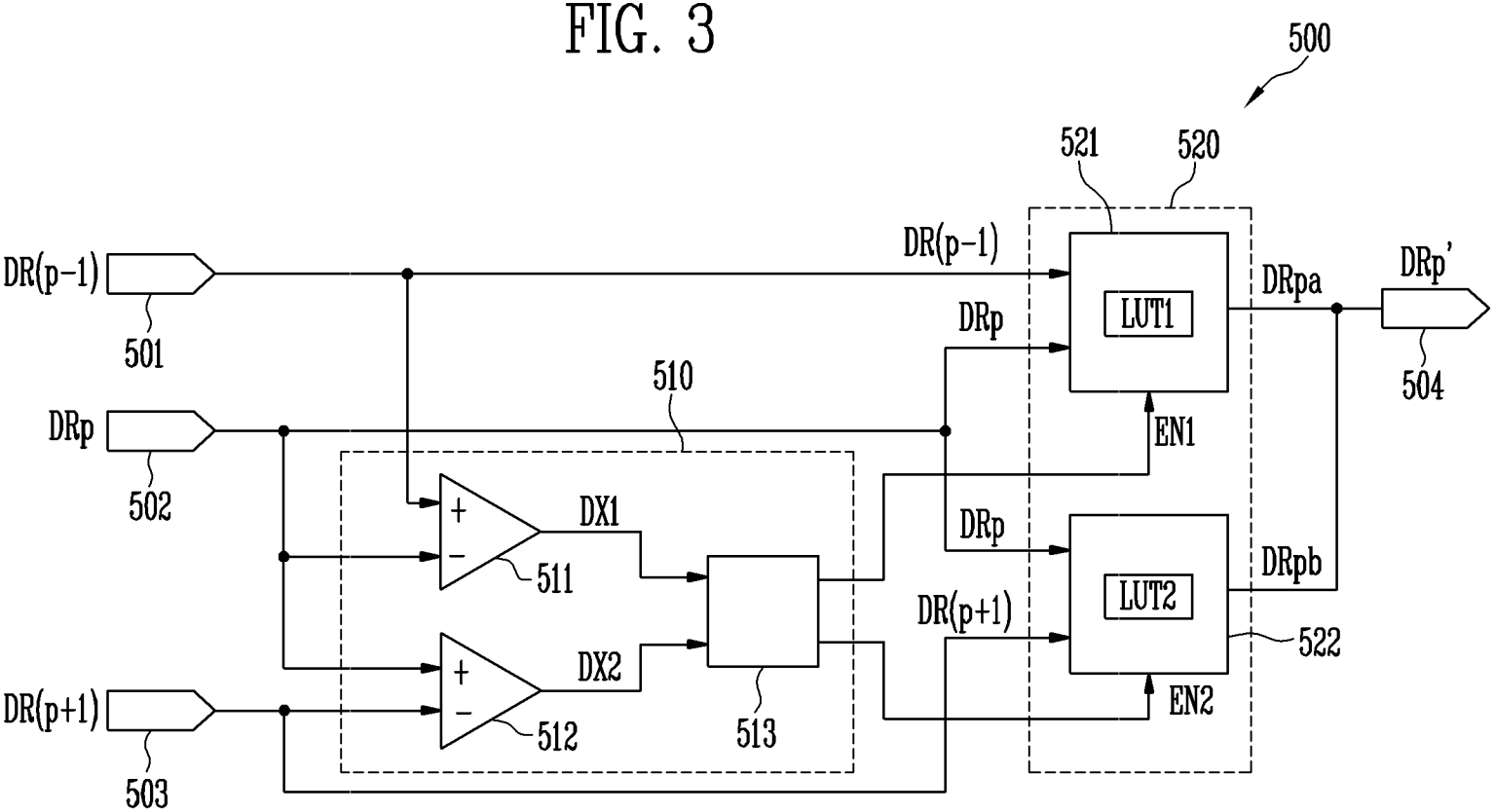
FIG. 3 is a diagram for describing a data compensator included in the display device of FIG. 1.
Figure 4:
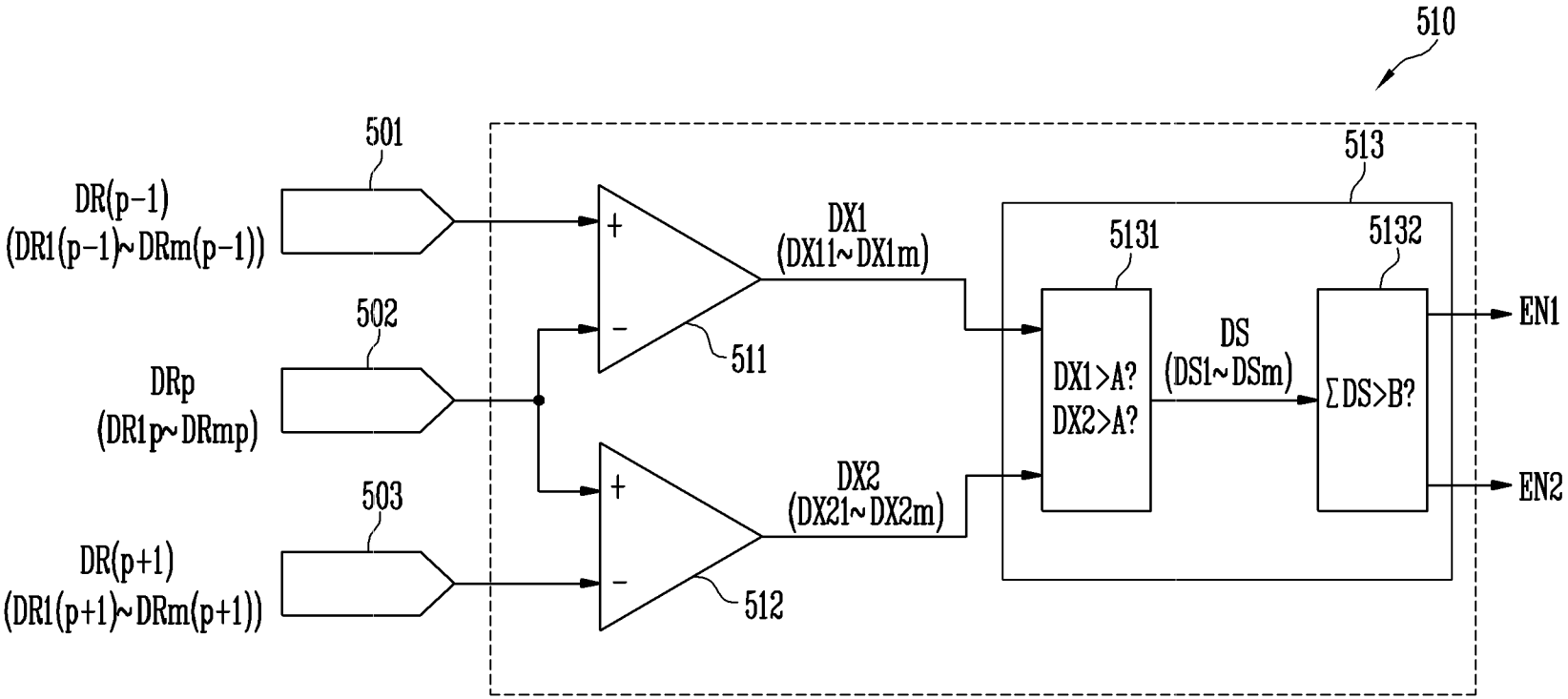
FIG. 4 is a diagram for describing a first driver included in the data compensator of FIG. 3.

FIG. 3 is a diagram for describing the data compensator included in the display device of FIG. 1. FIG. 4 is a diagram for describing a first driver included in the data compensator of FIG. 3. FIG. 5 is a diagram for describing determination data output by a first determiner included in the first driver of FIG. 4.

Referring to FIGS. 3 to 5, the data compensator 500 may receive line grayscale data DR(p−1), DRp, and DR(p+1) (p is a natural number greater than 1) of a previous pixel row, a current pixel row, and a subsequent pixel row through a first input terminal 501, a second input terminal 502, and a third input terminal 503, respectively. Specifically, first line grayscale data DR(p−1) (or the line grayscale data of the previous pixel row) may be input to the first input terminal 501, second line grayscale data DRp (or the line grayscale data of the current pixel row) may be input to the second input terminal 502, and third line grayscale data DR(p+1) (or the line grayscale data of the subsequent pixel row) may be input to the third input terminal 503.

The first to third line grayscale data DR(p−1), DRp, and DR(p+1) provided to the data compensator 500 through the first to third input terminals 501, 502, and 503 may be provided to each of a first driver 510 and a second driver 520.

The data compensator 500 may include the first driver 510 and the second driver 520.

The first driver 510 may generate one of a first activation signal EN1 and a second activation signal EN2 for selecting one of the first compensation and the second compensation based on the first line grayscale data DR(p−1), the second line grayscale data DRp, and the third line grayscale data DR(p+1), and may output the generated first activation signal EN1 and second activation signal EN2 to the second driver 520.

The second driver 520 may generate compensation grayscale data DRp' of the current pixel row in response to the first activation signal EN1 and the second activation signal EN2 provided from the first driver 510 and may output the compensation grayscale data DRp' to an output terminal 504.

Hereinafter, the configurations included in the first driver 510 and the second driver 520 of the data compensator 500 will be described in detail.

Referring to FIG. 4 together with FIG. 3, the first driver 510 may include a first data comparator 511, a second data comparator 512, and a compensation determiner 513.

The first data comparator 511 may compare the first line grayscale data DR(p−1) and the second line grayscale data DRp to output a first line comparison value DX1.

Here, the line grayscale data may be data including grayscale data for each of the plurality of pixels included in one pixel row. For example, the first line grayscale data DR(p−1) may include first to m-th grayscale data DR1(*p*−1) to DRm(p−1). The first grayscale data DR1(*p*−1) may be grayscale data of a pixel connected to a (p−1)-th scan line and the first data line DL1 (refer to FIG. 1), and the m-th grayscale data DRm(p−1) may be grayscale data of a pixel connected to the (p−1)-th scan line and the m-th data line DLm (refer to FIG. 1).

That is, the first data comparator 511 may respectively compare the first to m-th grayscale data DR1(*p*−1) to DRm (p−1) of the first line grayscale data DR(p−1) with the first to m-th grayscale data DR1*p* to DRmp of the second line grayscale data DRp to output the first line comparison value DX1.

The first line comparison value DX1 may include first to m-th grayscale comparison values DX11 to DX1*m*. For example, the first grayscale comparison value DX11 may be an absolute value of a difference between the first grayscale data DR1(*p*−1) of the first line grayscale data DR(p−1) and the first grayscale data DR1*p* of the second line grayscale data DRp, and the m-th grayscale comparison value DX1*m* may be an absolute value of a difference between the m-th grayscale data DRm(p−1) of the first line grayscale data DR(p−1) and the m-th grayscale data DRmp of the second line grayscale data DRp.

The second data comparator 512 may compare the second line grayscale data DRp and the third line grayscale data DR(p+1) to output a second line comparison value DX2.

That is, similar to the first data comparator 511, the second data comparator 512 may respectively compare the first to m-th grayscale data DR1*p* to DRmp of the second line grayscale data DRp with the first to m-th grayscale data DR1(*p*+1) to DRm(p+1) of the third line grayscale data DR(p+1) to output the second line comparison value DX2.

The second line comparison value DX2 may include first to m-th grayscale comparison values DX21 to DX2*m*. For example, the first grayscale comparison value DX21 may be an absolute value of a difference between the first grayscale data DR1*p* of the second line grayscale data DRp and the first grayscale data DR1(*p*+1) of the third line grayscale data DR(p+1), and the m-th grayscale comparison value DX2*m* may be an absolute value of a difference between the m-th grayscale data DRmp of the second line grayscale data DRp and the m-th grayscale data DRm(p+1) of the third line grayscale data DR(p+1).

The compensation determiner 513 may output one of the first activation signal EN1 and the second activation signal EN2 to the second driver 520 based on the first line comparison value DX1 output from the first data comparator 511 and the second line comparison value DX2 output from the second data comparator 512.

Specifically, the compensation determiner 513 may include a first determiner 5131 and a second determiner 5132.

The first determiner 5131 may output determination data DS based on the first line comparison value DX1 and the second line comparison value DX2. The first determiner 5131 may compare each of the first line comparison value DX1 and the second line comparison value DX2 with a preset first reference value A and may output the determination data DS based on a comparison result. The determination data DS output from the first determiner 5131 may be provided to the second determiner 5132.

The output of the determination data DS may be performed for each of the data lines DL1 to DLm (refer to FIG. 1). That is, the determination data DS may include a first determination value DS1 to an m-th determination value DSm for the respective data lines DL1 to DLm. For example, the first determination value DS1 may be a value output by comparing each of a first grayscale comparison value DX11 of the first line comparison value DX1 and a first grayscale comparison value DX21 of the second line comparison value DX2 with a first reference value A, and the m-th determination value DSm may be a value output by comparing each of an m-th grayscale comparison value DX1*m* of the first line comparison value DX1 and an m-th grayscale comparison value DX2*m* of the second line comparison value DX2 with the first reference value A.

As shown in FIG. 5, when both of the first line comparison value DX1 and the second line comparison value DX2 are greater than the first reference value A, the first determiner 5131 may determine that a corresponding data pattern is a toggle pattern and may output a first value as the determination data DS. In addition, when both of the first line comparison value DX1 and the second line comparison value DX2 are less than the first reference value A, the first determiner 5131 determines that the corresponding data pattern is a charge rate compensation pattern and may output the first value as the determination data DS. Here, the first value may be 0, but is not limited thereto.

Alternatively, when only one of the first line comparison value DX1 and the second line comparison value DX2 is greater than the first reference value A, the first determiner 5131 may determine that the corresponding data pattern is a crosstalk causing pattern and may output a second value as the determination data DS. Here, the second value may be 1, but is not limited thereto.

The second determiner 5132 may output the one of the first activation signal EN1 and the second activation signal EN2 based on the determination data DS provided from the first determiner 5131.

Specifically, the second determiner 5132 may summate the first to m-th determination values DS1 to DSm included in the determination data DS, compare the sum of the first to m-th determination values DS1 to DSm with a preset second reference value B, and may determine to output the one of the first activation signal EN1 and the second activation signal EN2.

For example, among the first to m-th determination values DS1 to DSm included in the determination data DS, when the number of first values (or "0") is k (k is an integer equal to or greater than 0 and equal to or less than m) and the number of the second values (or "1") is m−k, the second determiner 5132 may calculate m−k as the sum of the determination data DS. Next, the second determiner 5132 may compare the sum (for example, m−k) of the determination data DS with the second reference value B. When the sum of the determination data DS is equal to or less than the second reference value B (m−k≤B), the second determiner 5132 may determine that the charge rate compensation is required and may output the first activation signal EN1. When the sum value of the determination data DS is greater than the second reference value B (m−k>B), the second determiner 5132 may determine that crosstalk compensation is required and may output the second activation signal EN2.

Next, the second driver 520 may include a first compensator 521 and a second compensator 522.

The first compensator 521 may be activated in response to the first activation signal EN1, and may output first compensation data DRpa for the current pixel row based on the line grayscale data (for example, the second line grayscale data DRp) of the current pixel row and the line grayscale data (for example, the first line grayscale data DR(p−1)) of the previous pixel row adjacent to the current pixel row.

The first compensator 521 may include a first lookup table LUT1 in which the first compensation data DRpa corresponding to a relationship between the first line grayscale data DR(p−1) and the second line grayscale data DRp is stored.

The first compensator 521 may perform the first compensation. Here, the first compensation may be compensation for improving the charge rate of the pixel. As an embodiment, a data voltage corresponding to the first compensation data DRpa output according to the first compensation may be a voltage greater than a data voltage corresponding to the line grayscale data (for example, the second line grayscale data DRp) of the current pixel row. However, the disclosure is not limited thereto. As another embodiment, when a small data voltage is required to improve the charge rate of the pixel, the data voltage corresponding to the first compensation data DRpa may be a voltage less than the data voltage corresponding to the line grayscale data (for example, the second line grayscale data DRp) of the current pixel row.

The second compensator 522 may be activated in response to the second activation signal EN2, and may output second compensation data DRpb for the current pixel row based on the line grayscale data (for example, the second line grayscale data DRp) of the current pixel row and the line grayscale data (for example, the third line grayscale data DR(p+1)) of the next pixel row adjacent to the current pixel row.

The second compensator 522 may include a second lookup table LUT2 in which the second compensation data DRpb corresponding to a relationship between the second line grayscale data DRp and the third line grayscale data DR(p+1) is stored.

Meanwhile, in FIG. 3, only the second line grayscale data DRp and the third line grayscale data DR(p+1) are provided to the second compensator 522. However, this is for exemplarily describing that the line grayscale data are provided, and the disclosure is not limited thereto. That is, the second lookup table LUT2 of the second compensator 522 may include the second compensation data DRpb corresponding to the relationship between the first line grayscale data DR(p−1) and the second line grayscale data DRp.

The second compensator 522 may perform the second compensation. Here, the second compensation may be compensation for improving the crosstalk defect of the display device. As an embodiment, the data voltage corresponding to the second compensation data DRpb may be a voltage less than the data voltage corresponding to the line grayscale data (for example, the second line grayscale data DRp) of the current pixel row.

Figure 6A:
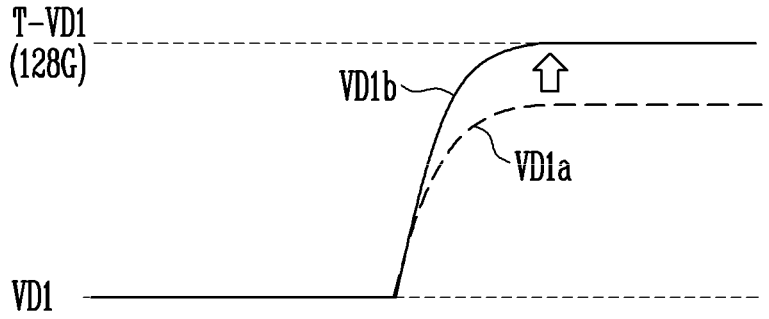
FIG. 6A is a diagram for describing an example of a data voltage compensated by first compensation of a first compensator.
Figure 6B:
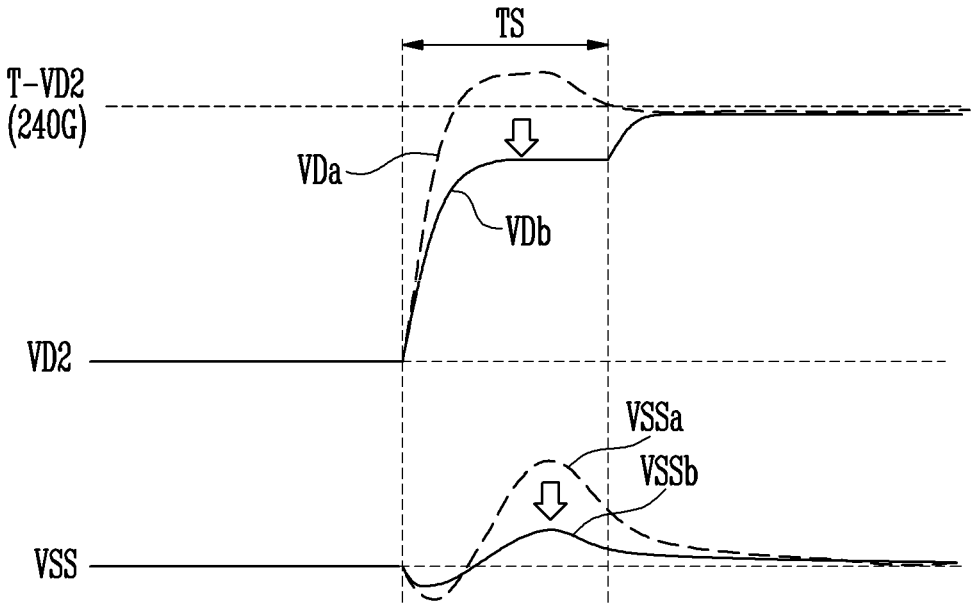
FIG. 6B is a diagram for describing an example of a data voltage compensated by second compensation of a second compensator.

FIG. 6A is a diagram for describing an example of a data voltage compensated by the first compensation of the first compensator. FIG. 6B is a diagram for describing an example of a data voltage compensated by the second compensation of the second compensator.

First, referring to FIGS. 3 and 6A, a data voltage VD1 may be provided to an arbitrary pixel. A first data voltage VD1*a* may be a data voltage before compensation, and a second data voltage VD1*b* may be a data voltage after the first compensation.

The first data voltage VD1*a* which is the data voltage before the compensation may be a voltage less than a target data voltage T-VD1 which corresponds to a target grayscale. For example, the target data voltage T-VD1 may be a data voltage for emitting the pixel at 128 grayscales. When a difference between the data voltage provided to the pixel of the current pixel row and the data voltage provided to the pixel of the previous pixel row is large, a sufficient data voltage may not be provided to the pixel of the current pixel row, for example, the first data voltage VD1*a* which is less than the target data voltage T-VD1 which corresponds to the target grayscale. That is, the first data voltage VD1*a* may be a data voltage for emitting the pixel at a grayscale less than 128 grayscales, rather than 128 grayscales which is the target grayscale.

The first data voltage VD1*a* may be compensated to the second data voltage VD1*b* by the first compensation of the first compensator 521. Here, the second data voltage VD1*b* may be a data voltage corresponding to the first compensation data DRpa and may be a voltage greater than the first data voltage VD1*a*. The second data voltage VD1*b* may be a data voltage for emitting the pixel at 128 grayscales which is the target grayscale. That is, the data voltage may be compensated such that the pixel emits light at the target grayscale by the first compensation, and the charge rate of the pixel may be improved by increasing the data voltage of the pixel.

Next, referring to FIGS. 2, 3, and 6B, a data voltage VD2 may be provided to arbitrary pixel. The first data voltage VDa may be a data voltage before compensation, and the second data voltage VDb may be a data voltage after the second compensation.

The first data voltage VDa which is the data voltage before the compensation may be a voltage greater than a target data voltage T-VD2 which corresponds to a target grayscale. For example, the target data voltage T-VD2 may be a data voltage for emitting the pixel at 240 grayscales. In a data change period TS, when a data voltage greater than the target data voltage T-VD2 is applied to the pixel, the second driving voltage VSS provided to the pixel may change. For example, when the first data voltage VDa is applied to the pixel, a second driving voltage VSSa provided to the pixel may change at a large width, and thus a magnitude of the driving current provided to the light emitting element LD may also change at a large width. That is, the light emitting element LD may emit light at a grayscale different from the target grayscale, and this may be recognized by the user as a crosstalk defect.

The first data voltage VDa may be compensated to the second data voltage VDb by the second compensation of the second compensator 522. The second data voltage VDb may be a data voltage corresponding to the second compensation data DRpb and may be a voltage less than the first data voltage VDa. That is, the second data voltage VDb may be a data voltage for emitting the pixel at a grayscale lower than 240 grayscales which is the target grayscale. When the second data voltage VDb of the voltage less than the first data voltage VDa is applied to the pixel, a change width of a second driving voltage VSSb may be greatly reduced compared to the first data voltage VDa, and the change of the driving current provided to the light emitting element LD may be minimized. That is, the data voltage may be compensated such that the pixel may emit light at a grayscale lower than the target grayscale by the second compensation, and the crosstalk defect of the display device may be improved.

Hereinafter, another embodiment of the data compensator will be described. In the following embodiment, the same configuration as in the previous embodiment is referred to by the same reference numeral, and description thereof will be omitted or simplified.

Figure 7:
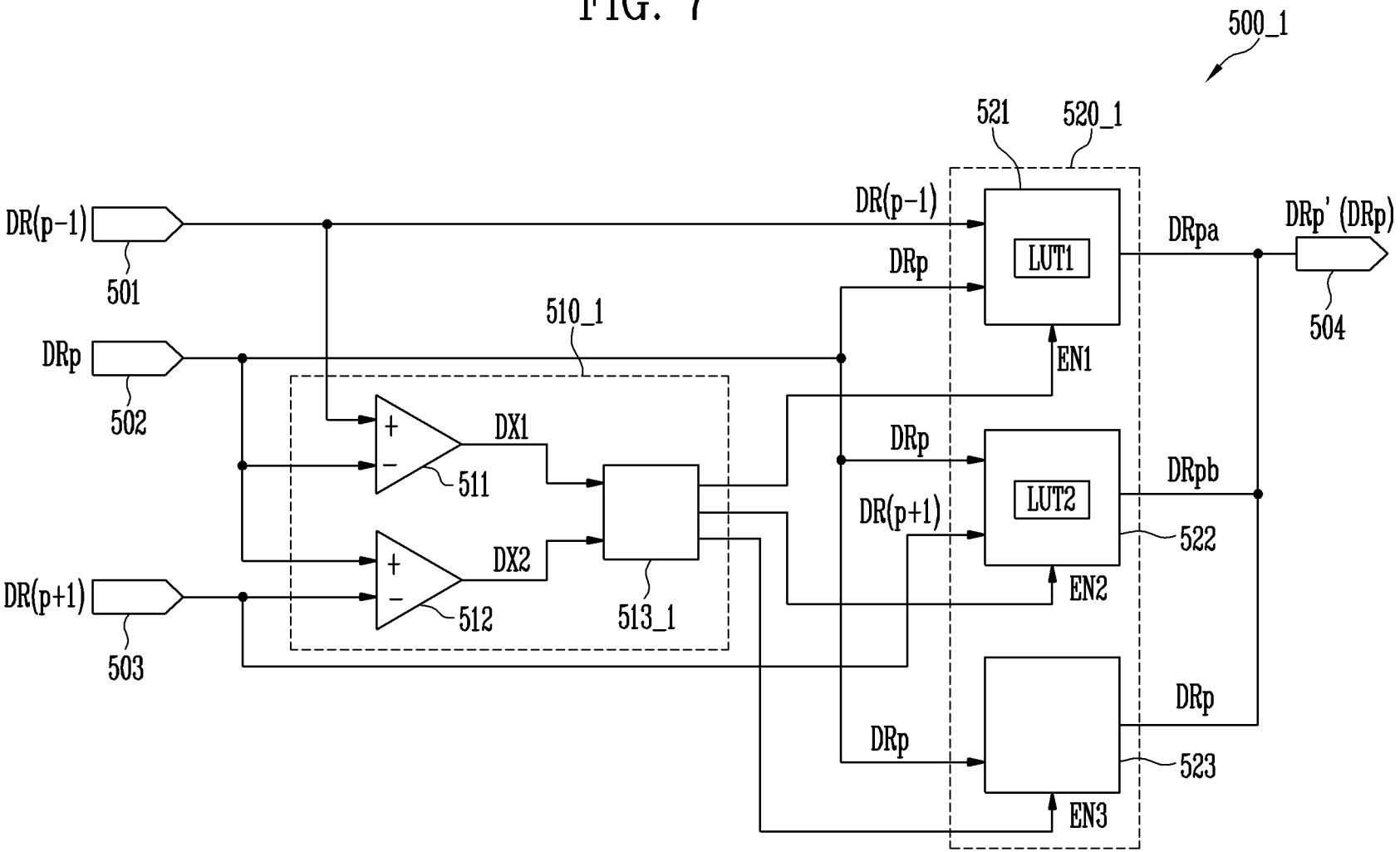
FIG. 7 is a diagram for describing the data compensator according to another embodiment.
Figure 8:
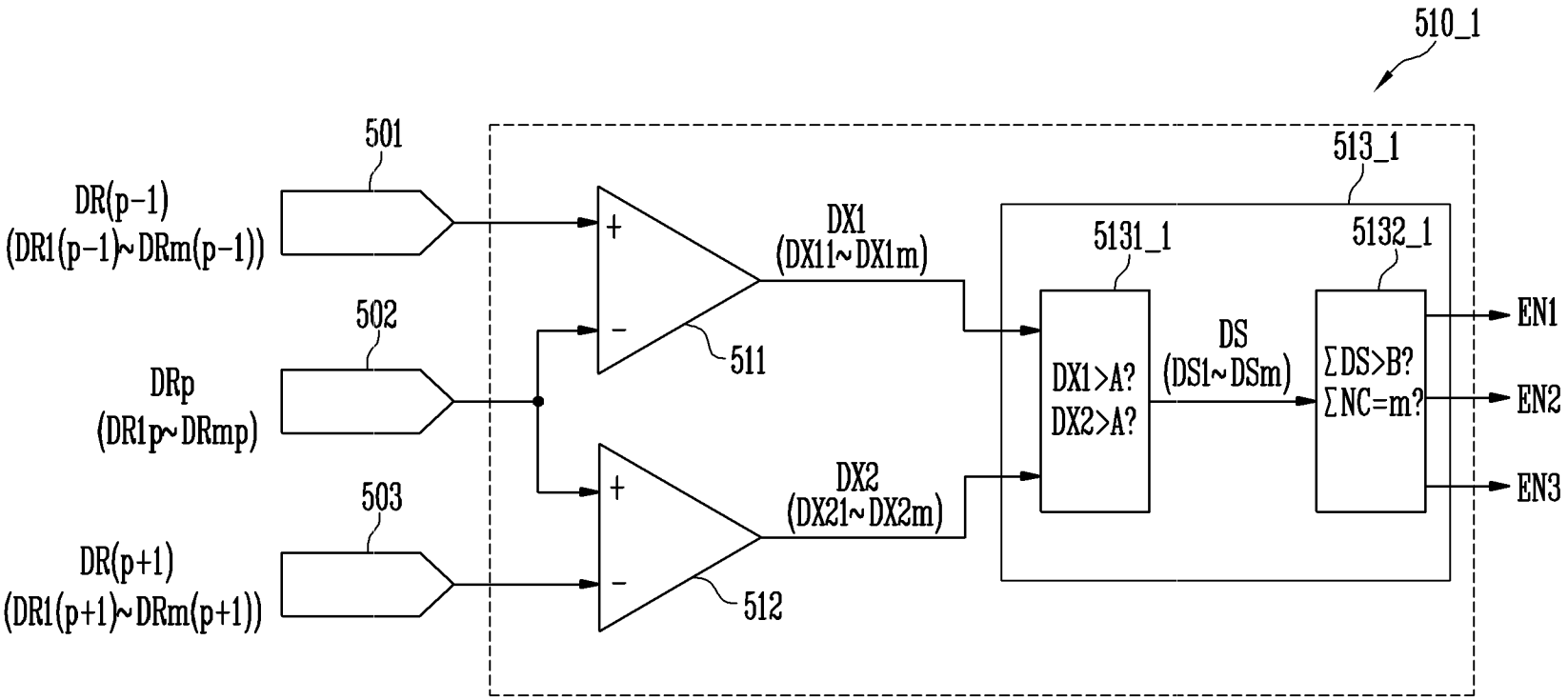
FIG. 8 is a diagram for describing a first driver included in the data compensator of FIG. 7.

FIG. 7 is a diagram for describing the data compensator according to another embodiment. FIG. 8 is a diagram for describing a first driver included in the data compensator of FIG. 7. FIG. 9 is a diagram for describing determination data output by a first determiner included in the first driver of FIG. 8.

The embodiment of FIGS. 7 to 9 is different from the embodiment of FIGS. 3 to 5 in that a second driver 520_1 further includes a non-compensator 523 activated in response to a third activation signal EN3 of a first driver 510_1. Hereinafter, the difference will be mainly described.

The data compensator 500_1 may include the first driver 510_1 and a second driver 520_1.

The first driver 510_1 may generate one of the first activation signal EN1, the second activation signal EN2, and the third activation signal EN3 for selecting one of the first compensation, the second compensation, and a non-compensation, based on the first line grayscale data DR(p−1), the second line grayscale data DRp, and the third line grayscale data DR(p+1), and may output the generated one of the first activation signal EN1, the second activation signal EN2, and the third activation signal EN3 to the second driver 520_1.

Differently from the embodiment of FIGS. 3 to 5, a compensation determiner 513_1 may further output the third activation signal EN3 based on the first line comparison value DX1 and the second line comparison value DX2.

Referring to FIG. 8, the compensation determiner 513_1 may include a first determiner 5131_1 and a second determiner 5132_1.

The first determiner 5131_1 may output the determination data DS based on the first line comparison value DX1 and the second line comparison value DX2. The first determiner 5131_1 may compare each of the first line comparison value DX1 and the second line comparison value DX2 with the preset first reference value A, and may output the determination data DS based on a comparison result. The determination data DS output from the first determiner 5131_1 may be provided to the second determiner 5132_1.

In the present embodiment, differently from the embodiment of FIGS. 3 to 5, the output of the determination data DS of the first determiner 5131_1 may be further subdivided. For example, as shown in FIG. 9, the first determiner 5131_1 may further compare the first line comparison value DX1 and the second line comparison value DX2 with 0, and may perform determination by subdividing the output into a case where the first line comparison value DX1 and the second line comparison value DX2 are greater than 0 and less than the first reference value A and a case where the first line comparison value DX1 and the second line comparison value DX2 are 0.

For example, in a case where the first line comparison value DX1 is 0, when the second line comparison value DX2 is greater than the first reference value A, the first determiner 5131_1 may output a second value (or "1") as the determination data DS. When the second line comparison value DX2 is greater than 0 and less than the first reference value A, the first determiner 5131_1 may output a first value (or "0") as the determination data DS.

In addition, in a case where the second line comparison value DX2 is 0, when the first line comparison value DX1 is greater than the first reference value A, the first determiner 5131_1 may output the second value as the determination data DS. When the first line comparison value DX1 is greater than 0 and less than the first reference value A, the first determiner 5131_1 may output the first value as the determination data DS.

Meanwhile, when both of the first line comparison value DX1 and the second line comparison value DX2 are 0, the first determiner 5131_1 may output a non-compensation signal NC. A case where both of the first line comparison value DX1 and the second line comparison value DX2 are 0 may mean that there is no data change (or data difference) in the previous pixel row and the subsequent pixel row adjacent to the current pixel row. That is, since the data of the pixels in the adjacent pixel rows are identical to each other, data compensation may not be required, and to this end, the non-compensation signal NC may be output as the determination data DS.

The second determiner 5132_1 may output one of the first activation signal EN1, the second activation signal EN2, and the third activation signal EN3 based on the determination data DS provided from the first determiner 5131_1. At this time, the second determiner 5132_1 may count the number of non-compensation signals NC included in the determination data DS. When the number of the non-compensation signals NC and the number of data lines DL1 to DLm (refer to FIG. 1) (for example, m) are identical to each other, the second determiner 5132_1 may output the third activation signal EN3. That is, the output of the third activation signal EN3 may correspond to a case where all of first to m-th determination values DS1 to DSm of the determination data DS are output as the non-compensation signal NC.

The second driver 520_1 may further include the non-compensator 523. The non-compensator 523 may be activated in correspondence with the third activation signal EN3, and may output the line grayscale data (for example, the second line grayscale data DRp) of the current pixel row as it is without compensation.

As described above, when the second driver 520_1 further includes the non-compensator 523 that outputs the line grayscale data of the current pixel row as it is, the data voltage may be prevented from being unnecessarily compensated, and power consumption of the display device may be reduced.

Although the embodiments of the disclosure have been described with reference to the accompanying drawings, it will be understood by those skilled in the art to which the disclosure pertains that the embodiments may be implemented in other specific forms without changing the technical spirit and essential features of the disclosure. Therefore, it should be understood that the embodiments described above are illustrative and are not restrictive in all aspects.

What is claimed is:

1. A display device comprising:

a plurality of pixel rows each including a plurality of pixels;

a data driver configured to provide first data voltages which correspond to first line grayscale data to pixels disposed in an (N−1)-th pixel row (N is a natural number greater than 2), provide second data voltages which correspond to second line grayscale data to pixels disposed in an N-th pixel row, and provide third data voltages which correspond to third line grayscale data to pixels disposed in an (N+1)-th pixel row; and a data compensator configured to compensate for the second line grayscale data by using one of a first compensation and a second compensation which is different from the first compensation based on the first line grayscale data, the second line grayscale data, and the third line grayscale data, wherein the data driver provides a compensated second data voltage to the N-th pixel row based on compensation grayscale data in which the second line grayscale data is compensated, the second line grayscale data is compensated such that a data voltage greater than a data voltage corresponding to the second line grayscale data is output by the first compensation, and the second line grayscale data is compensated such that a data voltage less than the data voltage corresponding to the second line grayscale data is output by the second compensation.

2. The display device according to claim 1, wherein the data compensator comprises:

a first driver configured to output one of a first activation signal and a second activation signal for selecting the one of the first compensation and the second compensation based on the first line grayscale data, the second line grayscale data, and the third line grayscale data; and a second driver configured to output the compensation grayscale data in response to the one of the first activation signal and the second activation signal.

3. The display device according to claim 2, wherein the first driver comprises:

a first data comparator configured to compare the first line grayscale data with the second line grayscale data to output a first line comparison value, a second data comparator configured to compare the second line grayscale data with the third line grayscale data to output a second line comparison value, and a compensation determiner configured to output the one of the first activation signal and the second activation signal based on the first line comparison value and the second line comparison value.

4. The display device according to claim 3, wherein the compensation determiner comprises:

a first determiner configured to output determination data based on the first line comparison value and the second line comparison value; and a second determiner configured to output the one of the first activation signal and the second activation signal based on the determination data.

5. The display device according to claim 4, wherein the first determiner compares each of the first line comparison value and the second line comparison value with a preset first reference value, when both of the first line comparison value and the second line comparison value are greater or less than the first reference value, the first determiner outputs a first value as the determination data, and, when only one of the first line comparison value and the second line comparison value is greater than the first reference value, the first determiner outputs a second value as the determination data.

6. The display device according to claim 5, wherein the second determiner compares a sum of the determination data with a preset second reference value, when the sum of the determination data is less than the second reference value, the second determiner outputs the first activation signal, and when the sum of the determination data is greater than the second reference value, the second determiner outputs the second activation signal.

7. The display device according to claim 3, wherein when all of the first line grayscale data, the second line grayscale data, and the third line grayscale data are the same, the first driver outputs a third activation signal, and the second driver outputs the second line grayscale scale data as it is in response to the third activation signal.

8. The display device according to claim 2, wherein the second driver comprises:

a first compensator configured to output first compensation data using the first compensation in response to the first activation signal; and a second compensator configured to output second compensation data using the second compensation in response to the second activation signal, and wherein the second driver outputs one of the first compensation data and the second compensation data as the compensation grayscale data.

9. The display device according to claim 8, wherein the second data voltage corresponding to the first compensation data is greater than the data voltage corresponding to the second line grayscale data.

10. The display device according to claim 9, wherein the first compensator includes a first lookup table in which the first compensation data corresponding to a relationship between the first line grayscale data and the second line grayscale data is stored.

11. The display device according to claim 8, wherein the second data voltage corresponding to the second compensation data is less than the data voltage corresponding to the second line grayscale data.

12. The display device according to claim 11, wherein the second compensator includes a second lookup table in which the second compensation data corresponding to a relationship between the first line data and the second line data is stored.

13. A method of driving a display device comprising a plurality of pixel rows, a data driver configured to provide data voltages to the plurality of pixel rows, and a data compensator configured to output compensation grayscale data, the method comprising:

comparing first line grayscale data for an (N−1)-th pixel row (N is a natural number greater than 2) with second line grayscale data for an N-th pixel row to output a first line comparison value;

comparing the second line grayscale data with a third line grayscale data for an (N+1)-th pixel row to output a second line comparison value;

outputting one of a first activation signal activating a first compensation and a second activation signal activating a second compensation which is different from the first compensation based on the first line comparison value and the second line comparison value;

outputting the compensation grayscale scale data in response to the one of the first activation signal and the second activation signal; and providing data voltages to the N-th pixel row based on the compensation grayscale data, wherein the second line grayscale data is compensated such that a data voltage greater than a data voltage corresponding to the second line grayscale data is output by the first compensation and the second line grayscale data is compensated such that a data voltage less than the data voltage corresponding to the second line grayscale data is output by the second compensation.

14. The method according to claim 13, wherein outputting the one of the first activation signal and the second activation signal comprises:

outputting determination data based on the first line comparison value and the second line comparison value; and determining the one of the first activation signal and the second activation signal based on a sum of the determination data.

15. The method according to claim 14, wherein outputting the determination data comprises:

comparing the first line comparison value and the second line comparison value with a preset first reference value;

outputting a first value as the determination data when both of the first line comparison value and the second line comparison value are greater or less than the first reference value; and outputting a second value as the determination data when only one of the first line comparison value and the second line comparison value is greater than the first reference value.

16. The method according to claim 15, wherein the first activation signal is output when the sum of the determination data is less than a second reference value by comparing the sum of the determination data with the second reference value.

17. The method according to claim 15, wherein the second activation signal is output when the sum of the determination data is greater than a second reference value by comparing the sum of the determination data with the second reference value.

18. The method according to claim 13, wherein outputting the compensation grayscale data comprises:

outputting first compensation data in response to the first activation signal;

outputting second compensation data in response to the second activation signal; and outputting one of the first compensation data and the second compensation data as the compensation grayscale data.

19. The method according to claim 18, wherein outputting the first compensation data in response to the first activation signal comprises using a first lookup table in which the first compensation data corresponding to a relationship between the first line grayscale data and the second line grayscale data is stored, and a data voltage corresponding to the first compensation data is greater than the data voltage corresponding to the second line grayscale scale data.

20. The method according to claim 18, wherein outputting the second compensation data in response to the second activation signal comprises using a second lookup table in which the second compensation data corresponding to a relationship between the first line grayscale data and the second line grayscale data is stored, and a data voltage corresponding to the second compensation data is less than the data voltage corresponding to the second line grayscale scale data.

* * * * *